US006282153B1

(12) United States Patent
Santos Neri

(10) Patent No.: US 6,282,153 B1
(45) Date of Patent: Aug. 28, 2001

(54) FLEXIBLE SYSTEM FOR SEALING CONTROL BUTTONS AND RELAYING MOVEMENT, FOR WATCHES AND OTHER INSTRUMENTS

(76) Inventor: Jose Luis Santos Neri, Travessa do Enviado de Inglaterra n. 20 - 1F, Lisboa (PT), P-1150

( * ) Notice: Subject to any disclaimer, the term of this patent is extended or adjusted under 35 U.S.C. 154(b) by 0 days.

(21) Appl. No.: 09/355,089

(22) PCT Filed: Jan. 19, 1998

(86) PCT No.: PCT/PT98/00001

§ 371 Date: Sep. 13, 1999

§ 102(e) Date: Sep. 13, 1999

(87) PCT Pub. No.: WO98/32056

PCT Pub. Date: Jul. 23, 1998

(30) Foreign Application Priority Data

Jan. 20, 1997 (PT) ..... 101960

(51) Int. Cl.[7] ..... G04B 37/00
(52) U.S. Cl. ..... 368/290
(58) Field of Search ..... 368/290, 289

(56) References Cited

U.S. PATENT DOCUMENTS 2,582,706 * 1/1952 Kudelski ..... 368/290
4,170,104 * 10/1979 Yamagata ..... 368/289
4,203,280 5/1980 Ziegler et al. ..... 368/187

* cited by examiner

*Primary Examiner*—Bernard Roskoski
(74) *Attorney, Agent, or Firm*—Brinks Hofer Gilson & Lione

(57) ABSTRACT

This invention relates to a rubber plate (elastic) (FIG.1) which, when soldered at its edges (FIG. 1A) to the inside of the body (case) of a watch (or other object) (FIG. 3A), totally seals it against water and dust. At the same time, in view of the fact that it is soldered at its sides (edges), its central part remains totally free, thus permitting the movement of the outside control buttons (FIG. 4C, D and 6A) and activating the mechanism, whether it is electronic (FIG. 3D) or mechanical (FIG. 5 and 7) (digital or analog). When the external controls are pressed, the corresponding function is switched on internally (FIG. 4E, F). A single plate (FIG. 3A) can be used for various controls (FIG. 3B, C) or one plate for each control (FIG. 4A, B), depending on the distance between them and the space available in the watch-case. This system, which involves extremely low costs, is not exclusive to watches and can be used for any instrument that is intended to be placed in deep water or where a lot of dust is present (or non-corrosive liquids), for example stopwatches, cameras, video cameras, floodlights, underwater weapons, etc., without the risk of any penetration, even at a great depth.

12 Claims, 3 Drawing Sheets

FLEXIBLE SYSTEM FOR SEALING CONTROL BUTTONS AND RELAYING MOVEMENT, FOR WATCHES AND OTHER INSTRUMENTS

The present invention relates to a sealing element consisting of a flexible plate for sealing control buttons, which is made of rubber and is designed to equip and allow watches and other electronic or mechanical instruments to be exposed to adverse conditions, such as water, dust and being placed in very deep water, without any infiltration at all.

The format of the plate can be oval, circular, triangular, square, rectangular, etc., and it also varies in thickness depending on the type of use required.

The raw material used is rubber, preferably vegetable rubber (extracted from the rubber-tree), since it is more flexible, soft and resistant, which are properties that have been proven in products such as surgical gloves, condoms and elastic materials.

The function of this system is to isolate the mechanism of an instrument from the outside world (without altering the functioning thereof), thus making it totally impossible for dust particles or water to infiltrate and therefore prolonging the useful life of the instrument in question, even if it is used under very adverse conditions.

For this purpose, the abovemention plate element must be fixed by means of a suitable process to the inside of the watch mechanism at the exact point where the control buttons are situated. The elasticity of the material used for the sealing element allows the element to be deformed when the control button is moved forward. It is therefore possible to guarantee the activation of the mechanism and the functions of the watch by activating the external command buttons, while maintaining the aforementioned internal mechanism completely isolated.

Watches with some sort of sealing already exist, namely diving watches. However, the control buttons for these types of watches are high precision valves which, although they are sometimes fallible, are extremely sophisticated and very expensive, which therefore increases the price of the watch.

Thus, although it is possible to demonstrate the need for watches that are waterproof or can withstand other adverse conditions, they are still considered as a "luxury goods".

With this new infallible system, it is now possible to produce a watch which is waterproof and can withstand other adverse conditions such as dust, etc. and which is good quality and cheap, meaning that wearers do not have to worry about taking the watch off for heavy-duty work, when they are having a bath, diving, having a shower, washing clothes, doing the washing-up, working near the cooker, etc.

Apart from the fact that it functions perfectly, the main advantage of this system for sealing controls, which does not allow any water to enter even when it is used under water, is the low cost thereof. This system can be used with sophisticated and luxury watches with a gold mechanism and case, as well as for very basic watches made of plastic, rubber, fiberglass, carbon or non-precious metal.

Everybody needs waterproof watches, irrespective of their sporting or professional activity. However, they are not accessible to everyone due to the fact that they are very expensive, in view of the aforementioned traditional control buttons. This new system transforms this situation once and for all in a practical, efficient and inexpensive way, as shown in the embodiments attached hereto.

For a clearer understanding of the description that follows, drawings of some of the possible embodiments of the invention are attached hereto, all relating to watches, which are of a non-restrictive nature and are simply intended as examples:

Figure 1:
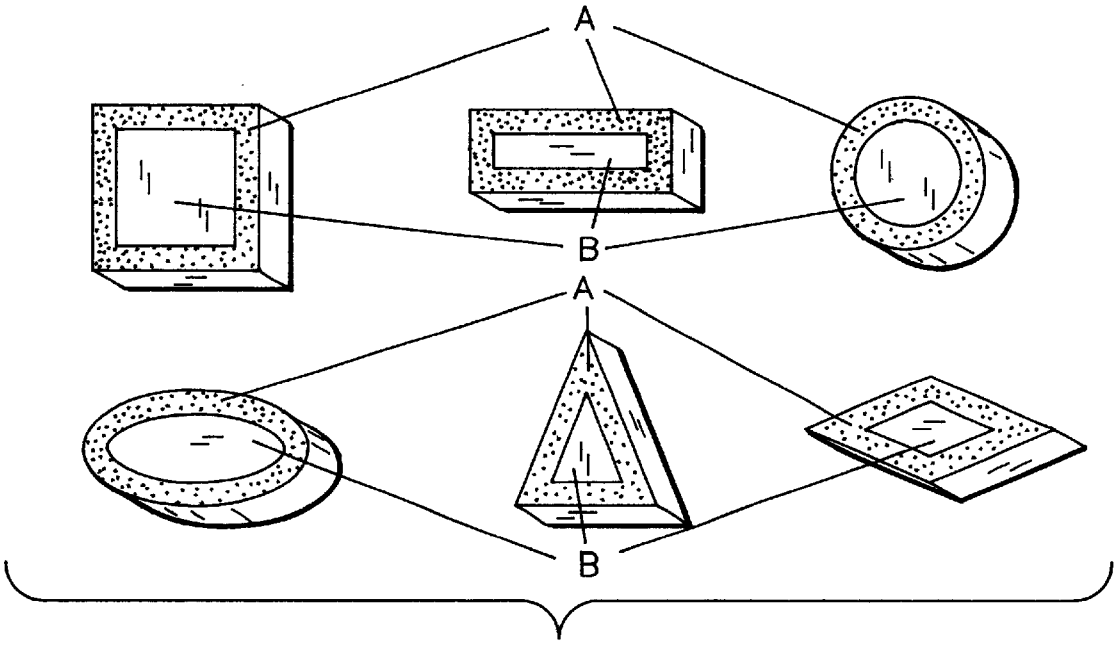
FIG. 1 shows a few sealing elements consisting of a plate with various possible embodiments.

As shown in the attached figures the sealing element consisting of a plate can take various forms, such as those shown in FIG. 1. The shaded area is where the plate is intended to be attached (1 A), for example by means of chemical soldering, and the white area in the center (1 B) is the free or flexible part, which relays the movements of the control buttons(3B,C).

Figure 2:
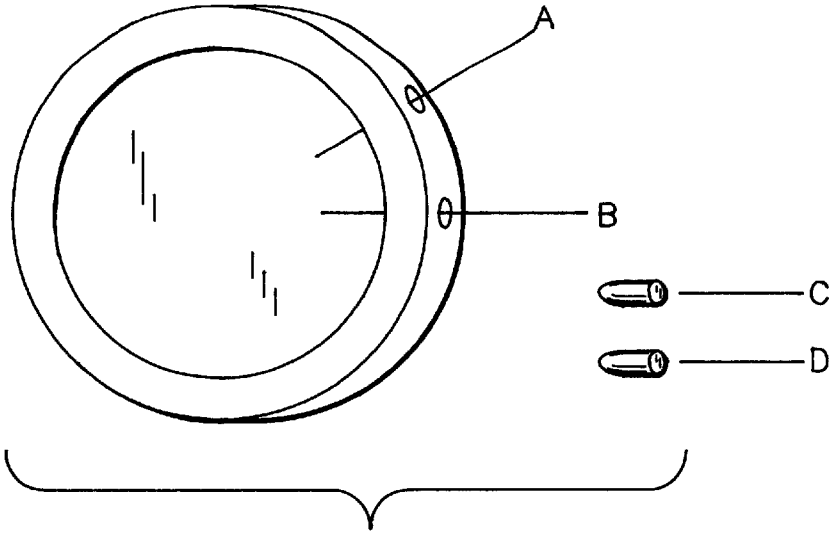
FIG. 2 shows a watch-case.

FIG. 2 represents a watch-case which shows the holes (2 A, B) through which the control buttons (2 C, D) activate the functions of the mechanism.

Figure 3:
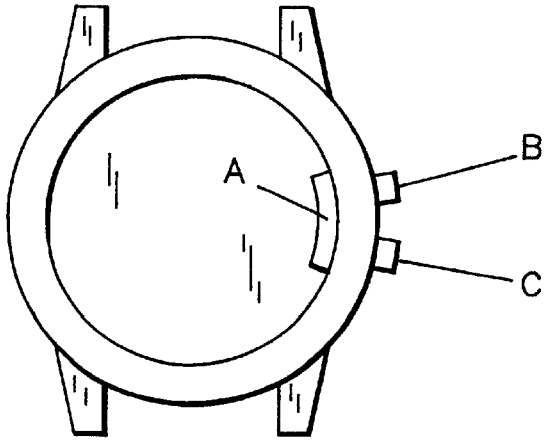
FIG. 3 shows a watch-case with a sealing element consisting of a plate fitted in place.

FIG. 3 shows a model where the system with a single plate (3 A) protects and relays the movements of the two (or more) control buttons (3 B, C). The mechanism (3 D) and its electronic controls (3 E, F) are therefore totally protected and can be activated without any difficulty.

Figure 4:
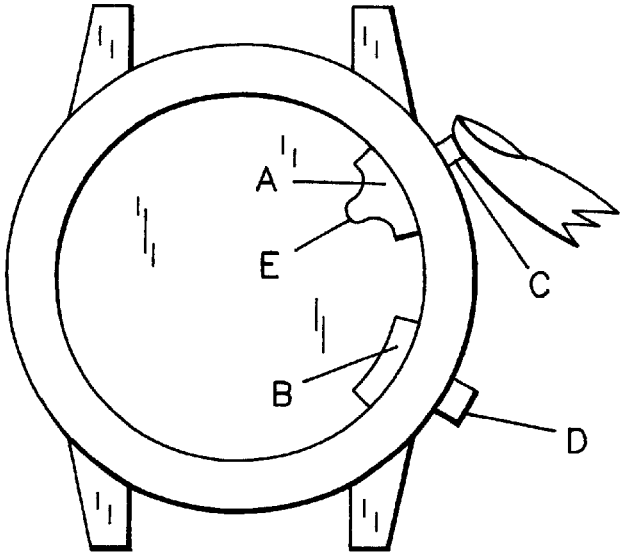
FIG. 4 shows a watch-case with two sealing elements consisting of a plate.

As shown in FIG. 4, the model watch has two control buttons that are far enough apart to justify the applications of two sealing elements consisting of a plate (4A, B), whereby each of the abovementioned plates protects one of the control buttons and allows it to be activated (4C, D). The control button (4 C) is being activated from the outside by the user and this movement (4 E) activates in turn the controls of the mechanism (4 F). As demonstrated, when the control buttons are activated this causes the elastic deformation of the sealing element consisting of a plate, which allows the mechanism to be activated by the movement of the control button, while maintaining a perfect seal between the exterior and the mechanism of the watch.

Figure 5:
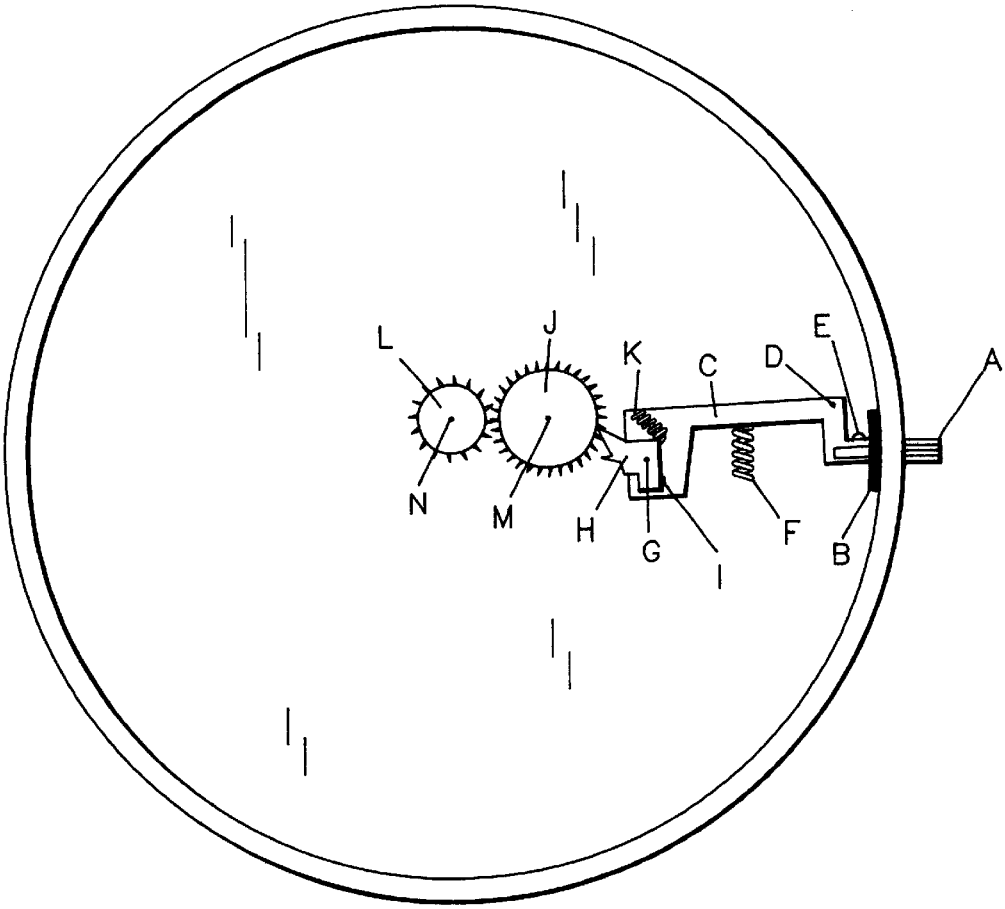
FIG. 5 shows a watch with a mechanical mechanism with a sealing element.
Figure 6:
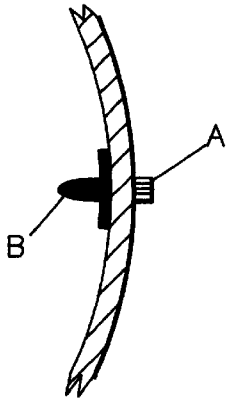
FIGS. 6 and 7 show push button and sealing element.
Figure 7:
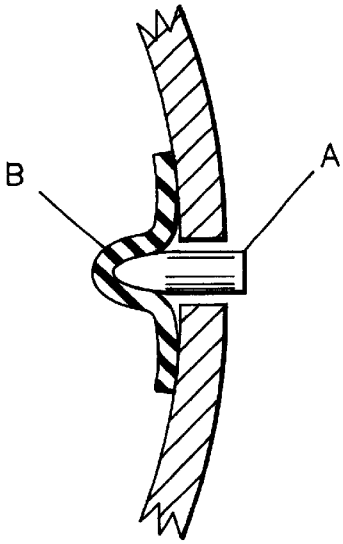

FIG. 5 and 6 show how a sealing element consisting of a plate functions in watches with a mechanical mechanism (or any object other than a watch), whatever the type of gearing used (manual or electric). Every time a control button is activated (5 A, 6 A), the sealing element consisting of a plate (5 B) makes an identical movement internally (6 B) by exerting pressure on the parts which adjust the time, date, etc. (and which, like the plates, may take various forms). The number of parts varies according to the number of control buttons that exist, which depends on the number of functions of the watch.

As demonstrated, the watch-case is fitted with a sealing element consisting of a plate which is suitably installed using an appropriate process. This element allows the movement of the control button to activate the mechanism described below, causing a cog to rotate which is attached to the extended end of the main axis of the mechanism, i.e. the axis which has the hands at the other end, thus allowing the time to be adjusted.

The abovementioned device that is illustrated here as a whole consists of a type of arm (5 C) fixed in such a was as to be able to move by means of an axis (5 D), around which the mechanism as a whole rotates. At one end of the device, next to the axis of attachment (5 D), precisely at the point which assimilates the movement of the plate (5 B, 6 B), in order to avoid wear and tear on the sealing element consisting of a plate (5 B), there is a wheel (5 E). The spring (5 F) forces the device as whole to go back to its rest position after each movement. At the other end there is a moveable part (5 H) that looks like the face of a dog, which is attached to the arm of the device (5 C) by means of an axis (5 G) and is held in place by means of a stopper (5 I), thus allowing it to move in relation to the arm when pressure ceases to be exerted on the secondary cog (5 J), then going back to its rest position assisted by the spring (5 K), when the arm returns from the position of exertion caused by the action of the control button and with the aid of the stopper (5 I) whose function is to prevent any backwards movement to the rest position while pressure is being exerted. The secondary cog (5 J) rotates in an anti-clockwise direction by virtue of the action of the moveable part (5 H) in order to exert pressure on the main cog (5 L) and cause clockwise movement (so as not to force or damaged the machine). The secondary cog (5 J) is attached by means of an axis (5 M) to a supporting part of the mechanism (which does not move), while the main cog (5 L) is fixed to the extension of the main axis of the mechanism (5 N), being the axis which couples the hands at the other end.

As mentioned above, the sealing element must be attached to the inside of the watch-case using a suitable process according to the material to be applied in the watch-case and in the mechanism. However, the quickest and most economical process is a chemical soldering process by means of gluing using a suitable material. This should be considered as the preferred embodiment of the invention. By way of a non-restrictive example we can mention the gluing process first of all using a glue made of a polyacrylate which dries rapidly (in a few minutes). Afterwards, a slow-drying glue made of an epoxy resin is applied to the edges of the sealing element consisting of a plate, in order to permanently cover any possible flaws in the first gluing process. These two gluing processes, which attach the sealing element to the watch-case, guarantee perfect results and prevent any infiltration of water or any other material, as demonstrated in numerous tests carried out by the inventor.

In order for the sealing system to be 100% effective, watches of this type can also be fitted with a system that transforms ordinary electronic watches into device that are extremely resistant to blows (using exaggerated tests). This systems involves filling all the empty spaces between the component parts with a substance made of paraffin which hardens after it has been applied, thus forcing each part to remain in place.

Since the possibility of failure in a digital mechanism is practically always due to a loose connection, watches are therefore guaranteed to last longer even when they are subjected to strong blows.

What is claimed is:

1. In an instrument having a case comprising a wall including at least one opening, an apparatus within the case, the apparatus including at least one control that is movable with respect to the case, and an actuator passing through the wall for moving the control, the improvement comprising:

at least one plate-like sealing element having a central portion and a peripheral portion, the peripheral portion being bonded to an inside surface of the case surrounding the at least one opening so that the central portion is situated between the actuator and the control and moveable therewith, the sealing element being effective to prevent environmental intrusion into contact with the instrument from outside the case through the at least one opening.

2. The improvement of claim 1 wherein the periphery of the at least one sealing element is in the form of a geometric figure selected from the group consisting of square, rectangle, circle, oval, triangle, and diamond.

3. The improvement of claim 1 wherein the at least one opening comprises a plurality of adjacent openings, each opening containing a separate actuator, the at least one sealing element having a peripheral portion of sufficient size to surround the plurality of adjacent openings so that the central portion contacts the separate actuators.

4. The improvement of claim 1 wherein the at least one sealing element is composed essentially of natural rubber.

5. The improvement of claim 4 wherein the bonded peripheral portion includes a layer of rapidly drying polyacrylate glue.

6. The improvement of claim 5 further comprising an outer edge formed by a slower-drying epoxy resin glue applied to the boned peripheral portion.

7. The improvement of claim 1 wherein the instrument is a watch.

8. In an instrument having a case comprising a wall including at least one opening, an apparatus within the case, the apparatus including at least one control that is movable with respect to the case, and an actuator passing through the wall for moving the control, the improvement comprising:

at least one plate-like sealing element having a central portion and a peripheral portion, the peripheral portion being bonded by a layer of a first glue that dries at a first rate to an inside surface of the case surrounding the at least one opening so that the central portion is situated between the actuator and the control so as to be movable therewith, and an outer edge formed by a slower-drying glue applied to the bonded peripheral portion, the sealing element being effective to prevent environmental intrusion into contact with the instrument from outside the case through the at least one opening.

9. The improvement of claim 8 wherein the first glue consists essentially of a polyacrylate glue which dries within a few minutes.

10. The improvement of claim 8 wherein the slower-drying glue consist essentially of an epoxy resin.

11. The improvement of claim 8 wherein the at least one sealing element is composed essentially of natural rubber.

12. In an instrument having a case comprising a wall including a plurality of adjacent openings, an apparatus within the case, the apparatus including at least a plurality of controls that are movable with respect to the case, and actuators situated in the adjacent openings and passing through the wall for moving the controls, the improvement comprising:

a plate-like sealing element having a central portion and a peripheral portion, the peripheral portion being boned to an inside surface of the case surrounding the plurality of openings so that the central portion is situated between the actuators and the controls and movable therewith, the sealing element being effective to prevent environmental intrusion into contact with the instrument from outside the case through the openings.

* * * * *